US005579592A

United States Patent [19]

Benoit et al.

[11] Patent Number: 5,579,592

[45] Date of Patent: Dec. 3, 1996

[54] ALPINE SKI BOOT WITH FLEXION CONTROL OF UPPER

[75] Inventors: Louis Benoit, La Balme de Sillingy; Laurent Bonaventure, Cran-Gevrier, both of France

[73] Assignee: Salomon S.A., Metz-Tessy, France

[21] Appl. No.: 322,481

[22] Filed: Oct. 14, 1994

[30] Foreign Application Priority Data

Oct. 15, 1993 [FR] France ..... 93 12454

[51] Int. Cl.[6] ..... A43B 5/04; A43B 5/16

[52] U.S. Cl. ..... 36/118.8

[58] Field of Search ..... 36/117, 118, 119, 36/120, 121

[56] References Cited

U.S. PATENT DOCUMENTS

| | | | |
|---|---|---|---|
| 4,454,663 | 6/1984 | Graillat et al. | 36/120 |
| 4,455,768 | 6/1984 | Salomon | 36/121 |
| 4,510,703 | 4/1985 | Eiteljorg | 36/119 |
| 4,910,888 | 3/1990 | Perrissoud | 36/121 X |
| 5,203,098 | 4/1993 | Perrissoud et al. | 36/120 X |
| 5,212,823 | 12/1993 | Perrissoud | 36/119 |
| 5,243,774 | 9/1993 | Mattiuzzo | 36/121 X |
| 5,329,707 | 7/1994 | Chaigne et al. | 36/120 |
| 5,345,698 | 9/1994 | Billet et al. | 36/117 |
| 5,363,571 | 11/1994 | Montfort | 36/119 |
| 5,426,872 | 6/1995 | Hayes | 36/117 X |

FOREIGN PATENT DOCUMENTS

| | | | |
|---|---|---|---|
| 0053340 | 6/1982 | European Pat. Off. | A43B 5/04 |
| 2497639 | 2/1983 | France | A43B 5/04 |
| 2686231 | 7/1993 | France | A43B 5/04 |
| 1963342 | 6/1971 | Germany . | |
| 3247515 | 1/1984 | Germany | A43B 5/04 |

*Primary Examiner*—B. Dayoan

*Attorney, Agent, or Firm*—Greenblum & Bernstein P.L.C.

[57] ABSTRACT

A ski boot structure in which the front cuff of the upper is intended to constitute the reference element ensuring all the functions related to the flexion control of said upper in cooperation with rigid extensions of the shell base and the closure device of the upper on the lower part of the skier's leg in skiing position. On the one hand, the front cuff includes abutments located opposite the abutments obtained on the extensions in the upper zone of the upper, and on the other hand, in the lower portion where it is extended by fastening hooks, an elastic element mounted in tension state to act in the front-to-rear direction. The closure device mutually connects the front cuff and rear spoiler on the inserted extensions while thus allowing the frontward flexion of the front cuff, and therefore of the upper, against the resistance of the elastic element without biasing said extensions and while rearwardly blocking said upper by means of the abutments of the cuff against those of the extensions.

15 Claims, 7 Drawing Sheets

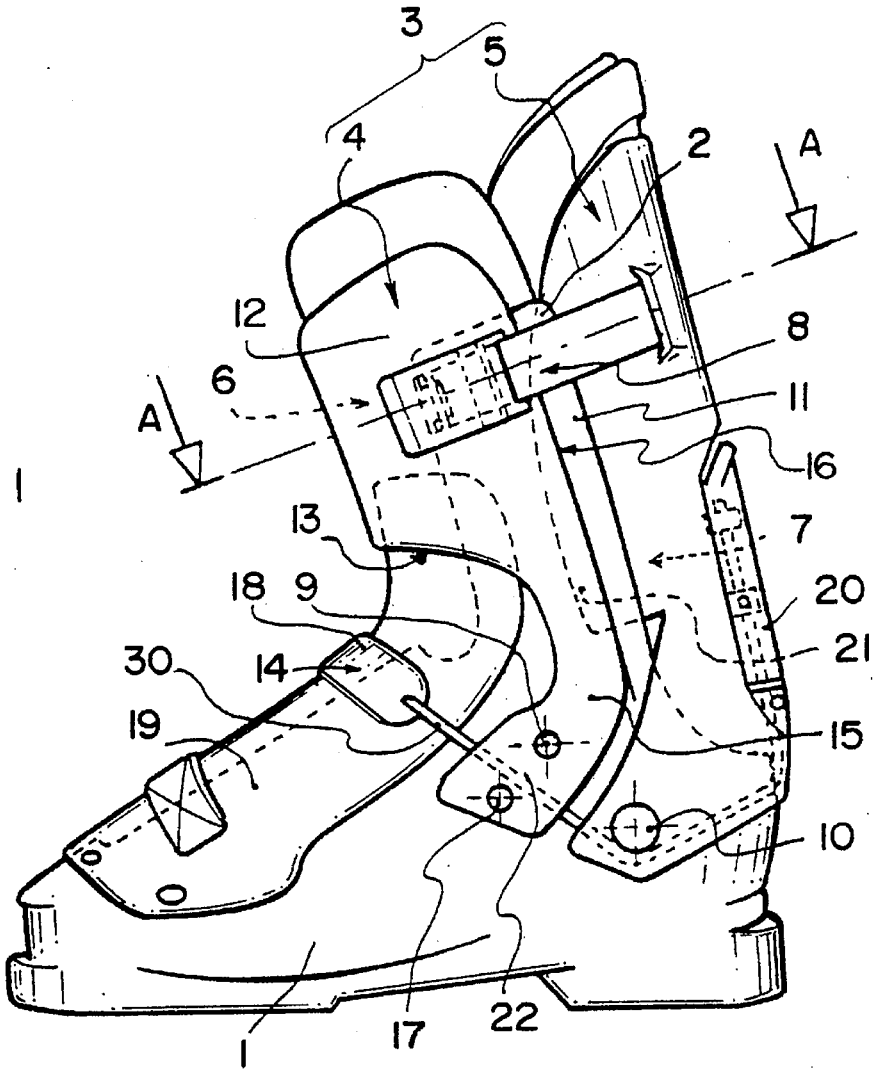
FIG. 1
FIG. 1a
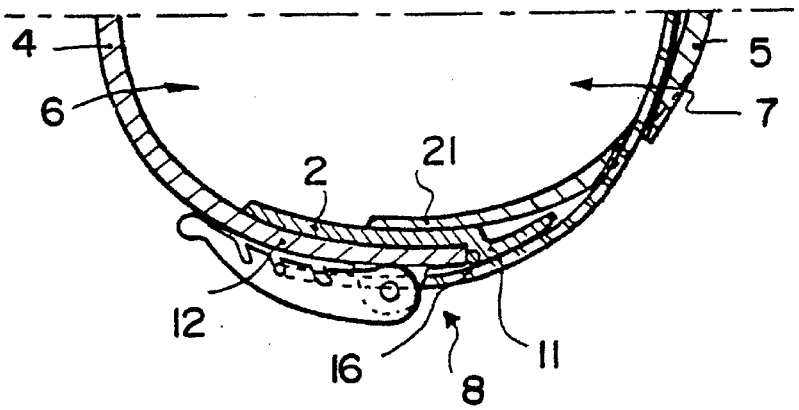

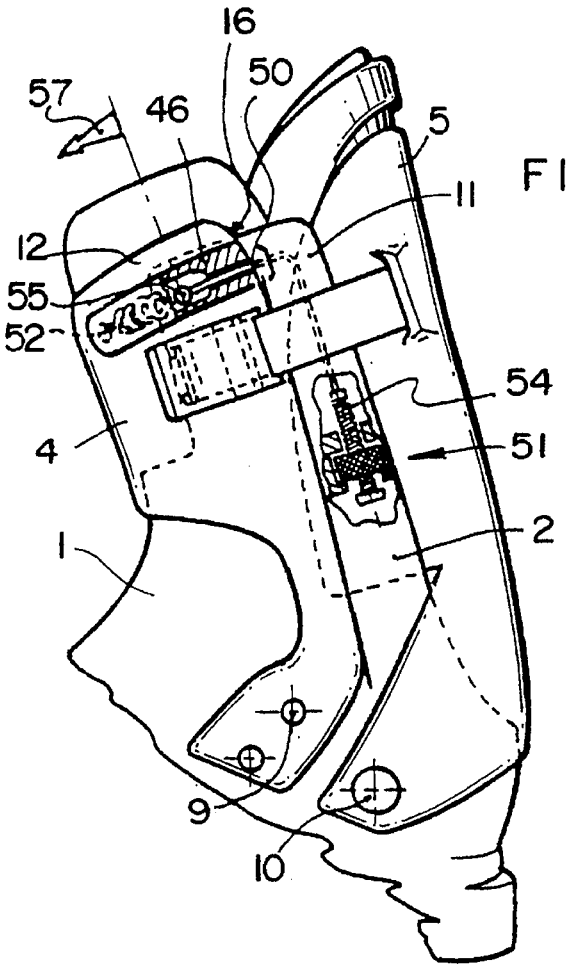
FIG. 9
FIG. 9a
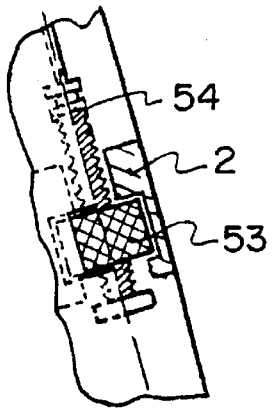
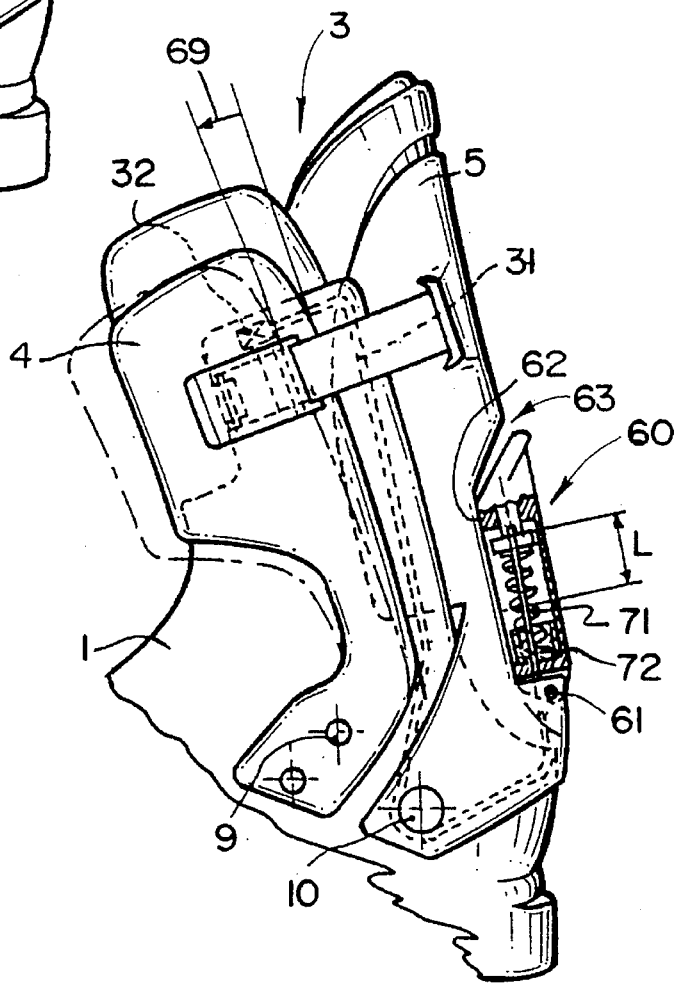
FIG. 10

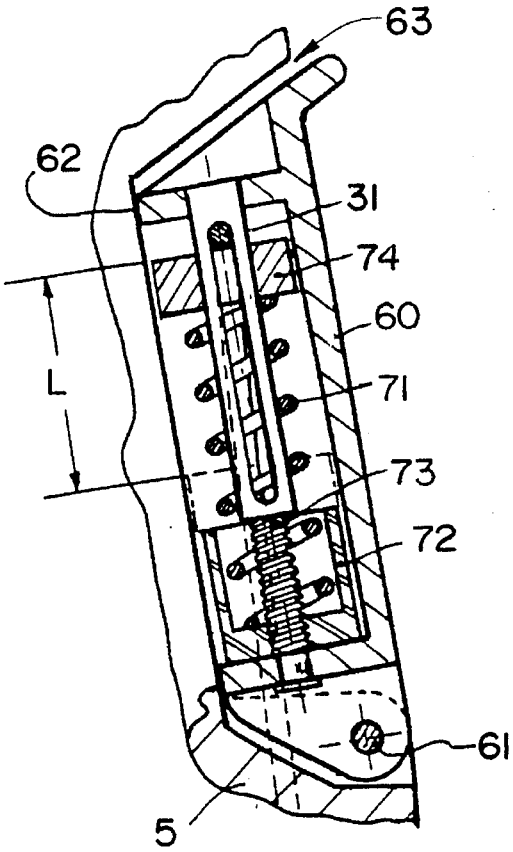
FIG. 11
FIG. 12
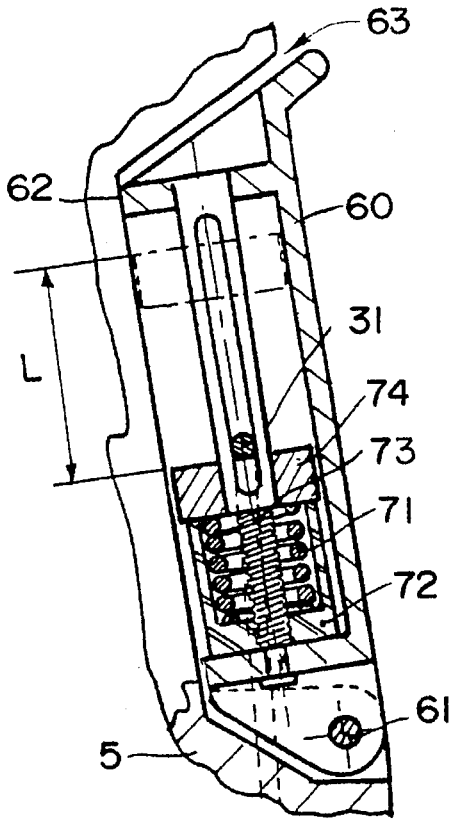
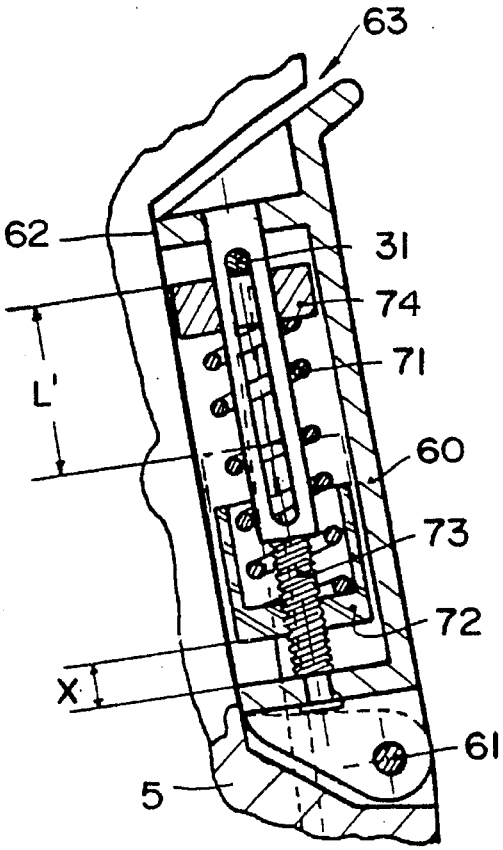
FIG. 13

ALPINE SKI BOOT WITH FLEXION CONTROL OF UPPER

BACKGROUND OF THE INVENTION

1. Field of the Invention

The present invention is related to a ski boot whose shell base is overlaid with an upper having a front cuff and a rear spoiler which are connected to one another along at least one upper extension of the shell base, and is related to the means used for controlling the flexion of the upper with respect to the shell base with regard to force, position, and clearance amplitude.

2. Discussion of Background and Material Information

A known boot of this type is described in patent application DE 3247515. According to this patent application, the flexion control of the upper, which covers two lateral extensions that extend up to the fore-foot, is ensured by means of an elastic element interacting between the cuff or front cuff and the shell base, whereas the clearance amplitude is determined by means of a tenon fixed on the shell base which cooperates with a slot of the front cuff, concentric to the journal axis of the latter.

It is also provided that the tenon and the slot are capable of being adjusted in position on the shell base to fix especially the angular end position of the front cuff towards the rear as well as the advance angle. In such a ski boot, although the basic functions of the flexion control of the upper are ensured, it appears however, that some of them are poorly accomplished.

Indeed, it is noted that the tenon-slot means for limiting the clearance amplitude of the front cuff and for determining the rear end position of the latter are located on this side of its journal axis, in the vicinity of the sole, whereas the portion of the front cuff actuated by the lower part of the leg is a channel-shaped upper front portion, the farthest away from the journal axis.

Now, such an arrangement of the means, with respect to the journal axis of the front cuff, determines a large lever arm between the channel of the latter and said axis, and a small lever arm between the tenon and the axis.

Consequently, the forces applied on the channel-shaped portion are transmitted and substantially increased in the area of the tenon-slot limitation means which constitute the resistance to the force applied and which, a special arrangement excepted, are destined for substantial wear and tear, even for a rapid destruction.

Likewise, this substantial difference of the lever arms and the spacing of the resistance point with respect to the point of application of the force also generates elastic deformations, even the buckling of the sides of the front cuff from its frontward or rearward abutment position on the limitation means, and thus not provide firm abutments limiting flexion amplitude, whereas these abutments are meant to determine the stiffness of the upper towards the front, and to determine the quality of the reclaiming of rear support towards the rear.

Moreover, since the described clearance amplitude limitation means of the front cuff are not mutually adjustable, it is not possible to modify the clearance value of the cuff between its rear support position which provides the advance angle, and its abutment position in front support from which the front cuff provides the maximum stiffness.

Another known boot of this type, also with flexion control means of the upper with respect to force, position, and amplitude, is described in patent application DE 19 63 342.

According to this document, the boot has a shell base which is provided along its sides with two vertical extensions on which are connected a front cuff and a rear spoiler, both journalled at their lower portion on the shell base.

These vertical extensions are each provided with a projecting lug which acts as an abutment for limiting frontward pivoting of the rear spoiler, and rearward pivoting of the front cuff, and possibly constitute flexion resistance means, which resistance can be modulated either by varying the friction conditions in the cuff overlapping zones on the extensions or by positioning intermediate elastic elements.

It is apparent from such a structure that the flexion amplitude of the upper cannot be controlled because it varies with the tightening positioning of the cuff and spoiler along the lower part of the skier's leg; indeed, when the cuff and spoiler are more or less close to one another, depending upon whether the lower part of the leg has a small or large perimeter, they come more or less close to the abutment lug, and therefore, their possibility of clearance is thereby more or less reduced.

Another disadvantage, related to the determination of the advance angle, results from the fact that the cuff and spoiler are reciprocally and individually adjustable by tightening along the lower part of the leg without reference abutment. Therefore, the front cuff and rear spoiler adopt the inclination imposed by the lower part of the skier's leg while putting on of the boot, and there is nothing to allow the skier to identically reproduce this inclination or advance angle in the other boot.

SUMMARY OF THE INVENTION

The present invention aims to overcome the disadvantages of ski boots of the type mentioned hereinabove, and especially aims to ensure a constancy of the advance angle of the upper, regardless of the perimeter of the lower part of the skier's leg, a front flexion clearance amplitude of the upper which is adjustable independent of the flexion force control means in order to vary the abutment position determining the stiffness without influencing these means, and a good support quality of the lower part of the skier's leg along the front cuff and rear spoiler. To this end, the invention provides that the rear-to-front abutment position, determining the front flexion stiffness, be obtained by means independent of those ensuring the rearward support quality of the lower part of the leg.

The invention also provides to arrange the means for closing the upper, those for controlling the amplitude of frontward flexion, and those for obtaining rear support of the upper in the upper zone of the latter, substantially in the same area as the supports of the lower part of the skier's leg along the cuff and spoiler of the boot upper.

As per the invention, the ski boot has, on the one hand, a rigid shell base provided with two vertical lateral extensions which extend in correspondence with and along the outside of the sides of the ankle and the lower part of the skier's leg by determining a "U"-shaped profile, seen in the direction transverse to the longitudinal axis of the shell base, and on the other hand, an upper comprising a rear spoiler and a front cuff located respectively behind and in front of the vertical extensions, and journalled by means of a pivoting linkage on the shell base in the malleoli zone. A device for tightening and closing the upper along the lower part of the leg is associated with the front cuff and rear spoiler in order to connect them together in the upper zone of the lateral extensions of the shell base on the one hand, and to render them interdependent, on the other hand. An elastic element is integrated in the lower portion of the front cuff and fixed to the shell base so as to elastically oppose the pivoting of the latter about its journal and thereby control its flexion.

The boot is characterized by the fact that an abutment is obtained in the upper zone of each of the vertical extensions of the shell base, substantially opposite the upper front zone of the front cuff on which the lower part of the leg takes support, and wherein the rear edges demarcating the wings of the front spoiler each comprise a corresponding abutment. It is also characterized by the fact that the elastic element is mounted in a pre-stressed state to ensure mutual cooperation of the abutments when putting on the boot and thereby maintain the front cuff in a stable locking position in the front-to-rear direction with respect to the shell base, and with controlled flexion position in the rear-to-front direction, whereas the rear spoiler remains free to pivot about its journal on the shell base and with respect to the vertical extensions of the latter.

With these arrangements, adjustment of the upper to the perimeter of the lower part of the skier's leg is undertaken under the action of the tightening device by the rear spoiler coming closer towards the front cuff, which guarantees the constancy of the advance angle of the upper by means of the front-to-rear support abutments. Advantageously, the abutments located on the vertical extensions of the shell base and/or those located on the rear edges of the front cuff are provided to be adjustable in position, at least in the horizontal direction, on the elements bearing them; thus, it is possible to modify and/or adjust the advance angle of the upper.

In closure position of the upper, these arrangements also provide the skier with a good quality of front-to-rear support on the rear spoiler because the support zone of his or her lower leg on the latter is located, vertically, substantially in correspondence with the upper zone of the vertical extensions of the shell base where the means ensuring its retention are arranged, i.e., the locking abutments towards the rear of the front cuff and the closure device of the upper.

Preferably, the abutments obtained in the upper zone of the vertical extensions project towards the outside of the boot and the "U"-shaped profile determined by the lateral vertical extensions of the shell base is closed in the upper front zone by the front cuff whose wings partially cover these extensions, and in the upper rear zone by the rear spoiler whose wings extend inside of said extensions. The front cuff is shaped, at least in part, like an incurved gutter or channel and corresponds with the front zone of the lower part of the skier's leg and is extended in its lower portion by means of two lateral fastening hooks which are pivotally connected to the sides of the shell base by means of rivets or screws, for example. Furthermore, the median portion of the channel portion is broadly scalloped in its lower portion to leave free the entire instep zone and the flexion fold, where foot retention devices are possibly provided.

Thus, during a frontward flexion of the lower part of the skier's leg along the front cuff, the latter is biased to bend against the resistance of the elastic element and simultaneously drive the rear spoiler in its movement by means of the closure device of the upper without biasing the vertical extensions of the shell base. Indeed, because of the "U"-shaped transverse profile of the shell base in the ankle zone, whose arms extend on either side and above the ankle, the lower part of the leg passes easily between the extensions which remain fixed and press directly on the front cuff and rear spoiler. Thus, these extensions serve both as lateral guides for the wings of the front cuff and rear spoiler and the closure device of the upper which connects the front cuff and rear spoiler and thereby ensure a reinforcement of the transverse retention of the upper.

In one embodiment on the front cuff, the lateral fastening hooks each comprise a more or less flexible extension which extends beyond their pivotal linking means on the shell base; the extension is then fixed and immobilized on the latter at a distance from the pivotal linking means. In this way, the extensions of the fastening hooks are capable of behaving like flexion springs and elastically oppose any pivoting of the front cuff. As per the invention, these extensions are immobilized on the shell base in a position where they are pre-tressed i.e., in initial mounting position they exert on the front cuff a permanent force directed in the front-to-rear direction, bringing the abutments of the cuff in pressure and in support against those of the vertical extensions of the shell base.

In another embodiment of the front cuff, a flexion bar is attached and fixed on at least two points on each of the lateral fastening hooks of the front cuff and extend beyond the pivotal linking means in the same way as the flexible extensions described hereinabove. It is obvious that the elastic element, constituted by flexible extensions of the lateral hooks of the front cuff or by a flexion bar such as described in the preceding examples, can be more or less pre-stressed as a function of the resistance force desired. To this end, the elastic element can be advantageously provided with an adjustment means capable of modifying the position of at least one of these fixing points and/or with a means such as a cursor, intended to stiffen the element at least partially in its flexible zone.

Still according to the invention, the boot is also characterized by the fact that a device for limiting the clearance amplitude of the front cuff in the rear-to-front direction, i.e., in front flexion, is positioned in the upper zone of the lateral extensions of the shell base, substantially in the same area as the abutments of the lateral extensions and those of the front cuff.

This limitation device comprises at least one flexible link which, connected to the front cuff and the lateral extensions of the shell base to join them, is adjustable lengthwise by means of a tensioner from a maximum tension position where the front cuff is blocked by its abutments against those of the lateral extensions of the shell base up to a release position of the link where the front cuff is allowed to pivot or bend frontwardly by moving away from the vertical extensions at a value in proportion to the length of the released link.

Thus, this device enables adjustment of the clearance amplitude of the upper, independent of the means for controlling the flexion force, and without having any effect thereupon. Furthermore, the position of the device in the upper zone of the vertical extensions in correspondence with that of the front cuff, provides a good quality of front support because the means opposing the flexion of the cuff are located opposite therefrom.

Advantageously, the limitation device is provided with an elastic tensioning system which cooperates with the flexible link in order to recuperate and/or store the length released or capable of being released of the latter, which it permanently maintains in a state of tension. Depending upon various constructions, the tensioning system is arranged either between the adjustment tensioner and the hooking point of the link on the front cuff or on the vertical extensions, or between the hooking end of the link and a retention shoulder, or else on the tensioner.

According to one embodiment, the flexible link forms a half-buckle which extends along the rear portion of the upper and whose two ends are fixed to the wings of the front cuff at the level of the abutments of the latter and of those of the vertical extensions; the link follows a predetermined path from the abutments and along each side of the boot, by means of returns and/or guides by passing approximately along the rotational axis of the pivotal link of the rear spoiler on the shell base to then ascend in the rear zone of the rear spoiler up to an adjustable tensioner in position and/or a tensioner having an adjustable cursor for fastening the link. Thus, when the upper, constituted of the front cuff and the rear spoiler connected by the closure device, pivots frontwardly between vertical the extensions of the shell base, the link is not subject to substantial or noticeable variation of its length, and it is basically the length of the released link during adjustment of the tensioner which determines the possible clearance amplitude of the front cuff and therefore of the upper, in the rear-to-front direction.

According to another embodiment of the limitation device, the latter comprises two independent flexible links. In this case, on the one hand, each flexible link is arranged on a side of the boot where it connects the corresponding wing of the front cuff to the vertical extension of the shell base located opposite therefrom, and is provided with a tensioner, on the other hand. It ensues from this structure that the amplitude limitation of the front cuff can be asymmetrically modulated; indeed, if for example, the length of the released link is greater on the external side of the upper than on the internal side, the front cuff will be capable of bending along a rear-to-front movement with outward inclination as soon as the internal link is in tension, this can be interesting for a skier whose tibia is substantially outwardly inclined.

BRIEF DESCRIPTION OF THE DRAWINGS

The invention will be better understood upon reading the following description with reference to the annexed exemplary schematic drawings illustrating different embodiments thereof:

FIGS. 1 and 2 represent an elevated view of a ski boot according to the invention in the position for putting on the boot and/or for skiing (FIG. 1) and in front flexion position (FIG. 2).

FIG. 1*a* is a partial sectional view along line A—A of the boot of FIG. 1 and shows a constructional detail of the boot upper, the front cuff being in support on the vertical extensions of the shell base.

FIG. 9 shows an embodiment of an amplitude limitation device of the front cuff comprising two independent flexible links.

FIG. 9*a* shows an embodiment detail of the tensioner.

FIG. 10 shows an elevated view of the boot according to the invention, in which the elastic tensioning system is arranged on the tensioner itself.

FIGS. 11, 12 and 13 illustrate an example of such a tensioner in initial position (FIG. 10) in maximum flexion position of the front cuff (FIG. 12), and in an intermediate adjustment position (FIG. 13).

DETAILED DESCRIPTION OF THE PREFERRED EMBODIMENTS

Figure 2:
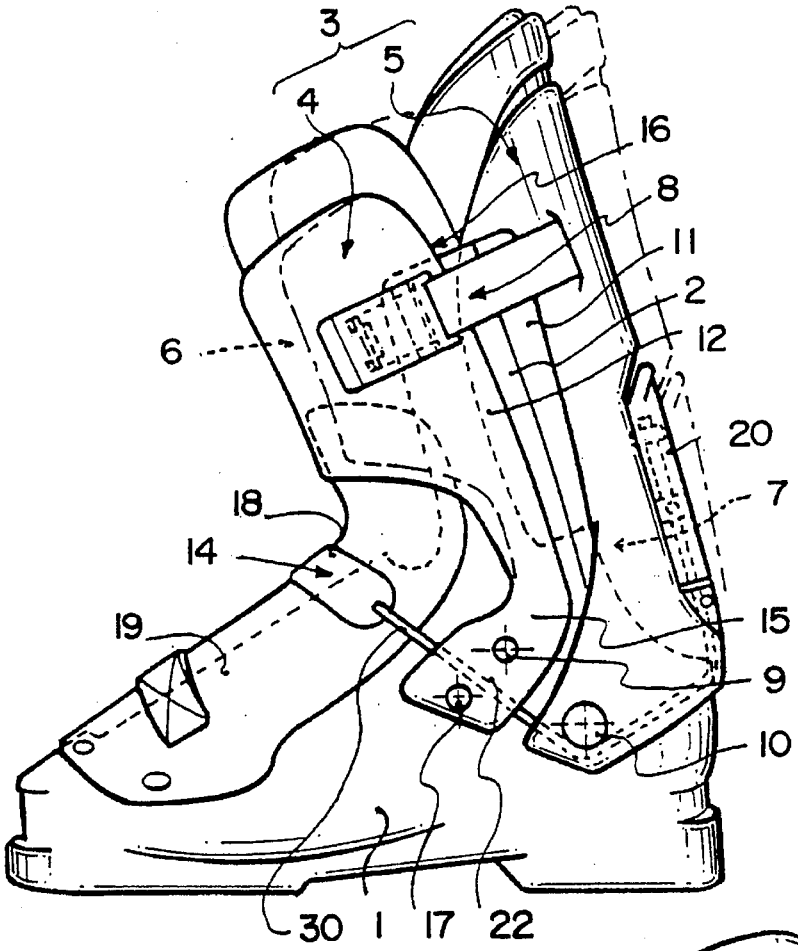

The ski boot schematically represented in FIGS. 1, 1*a*, and 2 is of the "rear entry type" and has a general structure wherein:

—a shell base 1 that, on the one hand, is overlaid with an upper 3 constituted of a front cuff 4 and a rear spoiler 5, and on the other hand, is provided with two vertical extensions 2 which extend in correspondence with and along the outside of the sides of the ankle and the lower part of the skier's leg, —transverse to the longitudinal axis of shell base 1, vertical extensions 2 determine a "U"-shaped profile that opens into the upper front zone 6 and rear zone 7 of shell base 1, and comprise rearward support abutments 11 of front cuff 4, —retention upper 3 of the lower part of the leg cooperates with vertical extensions 2 by means of front cuff 4 and rear spoiler 5 which, journalled in 9 and 10 on shell base 1, close the front 6 and rear 7 zones of the "U"-shaped transverse profile determined by the latter, —a tightening 8 and closure device of upper 3 is associated with front cuff 4 and rear spoiler 5 to mutually connect the latter along the inserted vertical extensions 2, —an elastic element 22 is integrated in the lower portion of front cuff 4 in order to elastically oppose the pivoting of the latter in the rear-to-front direction, and thus ensures the flexion control of upper 3 when front cuff 4 and rear spoiler 5 are mutually connected by means of tightening device 8, —front cuff 4 is shaped like an incurved channel which, by means of its wings 12, partially covers vertical extensions 2 of shell base 1 and is extended in its lateral lower portion by two fastening hooks 15 pivotally connected to the sides of shell base 1 by means of rivets 9, a scallop, openings, or recess 13 leaving free the entire instep zone and the flexion fold of the skier's foot where a foot retention device 14 is provided.

In this example, foot retention device 14 comprises a tightening strap 18 which takes support on a flexible lower cuff 19 in the instep zone at the flexion fold, and which is connected to a flexible cable 30 which is tension activated by a tensioner 20 located in the rear zone of rear spoiler 5. Preferably, flexible cable 30 is directed obliquely from its grip on strap 18 and passes round linkage 10 of rear spoiler 5; in this way, the tightening force which is applied on lower cuff 19 and consequently on the top of the skier's foot, is substantially directed towards the heel ensuring an optimum blocking of the latter in the boot.

According to one characteristic of the invention, abutments 11 of the laterally positioned vertical extensions 2 are obtained in the upper zone of the extensions opposite the upper front zone of front cuff 4 where the lower part of the skier's leg takes support; advantageously, rear edges 16, demarcating wings 12 of front cuff 4, constitute the abutments of the latter and abutments 11 of extensions 2 are directed outwardly.

According to another characteristic, elastic element 22 is fixed (9–17) on shell base 1 in a pre-stressed state causing the pivoting of front cuff 4 about its linkage 9 in the front-to-rear direction and mutual cooperation of abutments 11 and 16. It results from this assembly that front cuff 4 is maintained in blocking position in the front-to-rear direction and controlled flexion position in the rear-to-front direction.

In the present boot structure, elastic element 22 is constituted by extensions of fastening hooks 15 of front cuff 4 which extend beyond linkages 9 of the latter, and which are immobilized on shell base 1 by means of linkages 9 and rivets 17, for example. It is obvious that fastening hooks can also be flexible for participating in the flexion control.

According to a constructional detail, on the one hand, wings 21 of rear spoiler 5 extend inside vertical extensions 2 of the shell base, and tightening device 8 connects front cuff 4 and rear spoiler 5 by covering said vertical extensions 2 from the outside. Thus, vertical extensions 2 act as lateral guides for wings 12 and 21 of front cuff 4 and rear spoiler 5, as well as for tightening device 8 which mutually connects the latter, and reinforce the transverse retention of upper 3.

Figure 3:
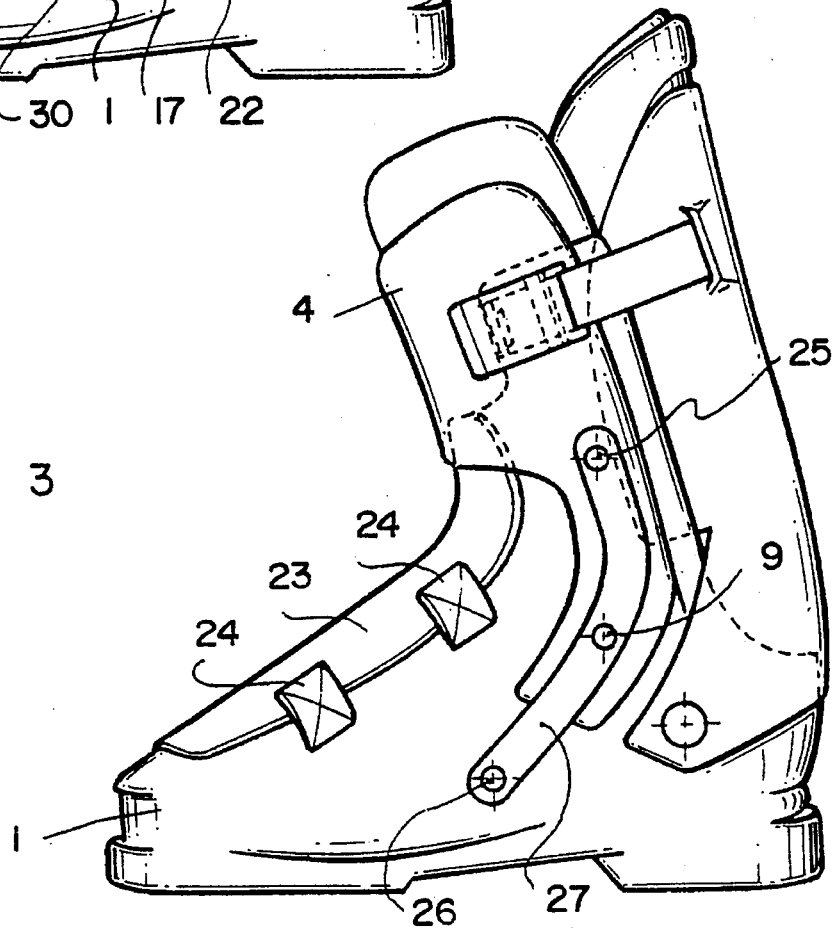
FIG. 3 illustrates an elevated view of another ski boot according to the invention, whose front cuff is provided with a flexion control means attached to its fastening hooks.

In the constructional example shown in FIG. 3, the ski boot only differs from those of the preceding figures in that the elastic element is constituted of a flexion bar 27, and that shell base 1 closes on the top of the foot by means of overlapping transverse flaps 23 or tongues, which are pressured by hooks or tensioners 24 of a known type. In this example, flexion bar 27 is fixed to a first point 25 on front cuff 4, to a second point 26 on shell base 1, and to a third point which is the axis of linkage 9 of front cuff 4 on the shell base.

Figure 4:
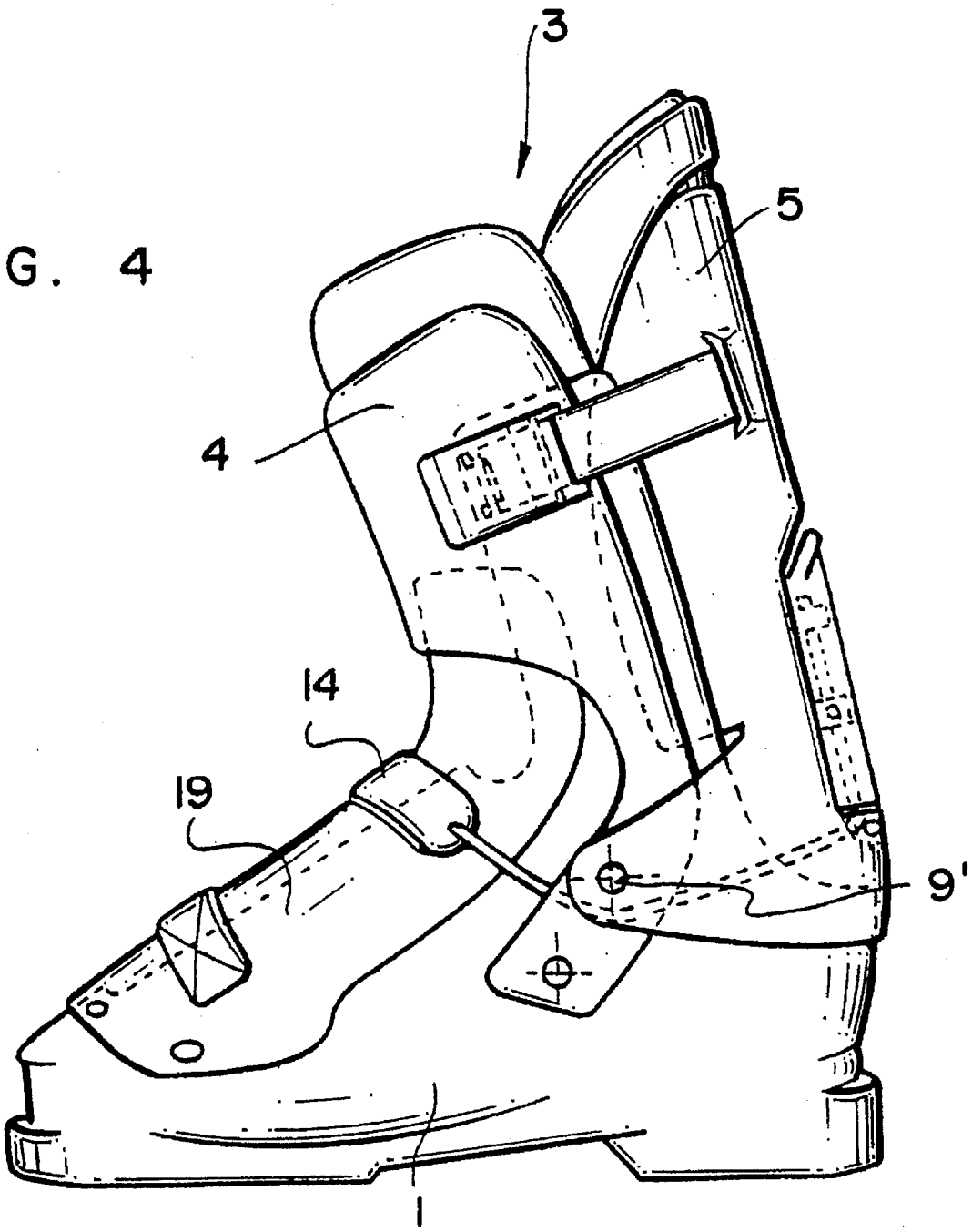
FIG. 4 shows another structure of the boot according to the invention, in which the front cuff and rear spoiler are connected to the shell base around a common axis.

In FIG. 4, the ski boot shown is equivalent to that of FIGS. 1 and 2 and is only distinguished from the latter in that rear spoiler 5 of upper 3 is connected to shell base 1 on the same linkage means 9' as front cuff 4.

Still in accordance with the invention, and as is represented in FIGS. 5, 5*a*, 5*b* and 6, the ski boot is provided with a clearance amplitude limitation device of front cuff 4, in front flexion with respect to shell base 1 and vertical extensions 2 of the latter.

In order to guarantee an excellent quality of front support to the lower part of the skier's leg in extreme abutment position, determining the stiffness, the means ensuring the retention of cuff 4 are arranged in the upper zone of vertical extensions 2 substantially in the same area as abutments 11–16 and the upper zone of the cuff 4. These means are constituted by an inextensible flexible link 31 which is hooked to wings 12 of front cuff 4 by its ends 32 and which, after guiding and returning through openings 33 obtained in the support surface of abutments 11, extends towards the bottom of the structure of shell base 1 to then pass along journal axis 10 of rear spoiler 5 and ascend to the rear zone of the latter up to a tensioner 34. Flexible link 31 thus forms a half-buckle which is closed frontwardly by front cuff 4. As shown, flexible link 31 is preferably guided in a hollow structure such as an elongated corridor 40 obtained in vertical wings 2 of shell base 1, this corridor possibly capable of being provided with an open profile on the inner side of the boot; with this arrangement, flexible link 31 is protected from the outside and can, during its adjustment by means of tensioner 34, be relatively loose or relaxed without causing risks of hooking, deterioration or hinderance.

In this example, tensioner 34, which can be of any known type, is of the type having a lever journalled from the base up with a rotationally maneuverable threaded element 36, on which is screwed a fastening cursor 37 of link 31.

Thus equipped, upper 3 of the ski boot as per the invention is capable of pivoting frontwardly according to a predetermined clearance amplitude proportional to the length of link 31, released beyond its maximum tensioning position where front cuff 4 is blocked against abutments 11. As an example, FIG. 5, cursor 37 of the tensioner is shown in intermediate lower position, i.e., it has been downwardly translationally displaced along arrow 38, which has generated a certain length release of link 31, schematically illustrated with an "S"-shaped dotted line in elongated corridor 40 of vertical extensions 2. In this initial position, front cuff 4 is maintained in support on abutments 11 due to the permanent action of elastic element 22 on the latter, i.e., it is blocked in the front-to-rear direction but remains capable of bending frontwardly if the force which is applied thereon by the lower part of the skier's leg is greater than the resistant force of said elastic element 22.

Figure 6:
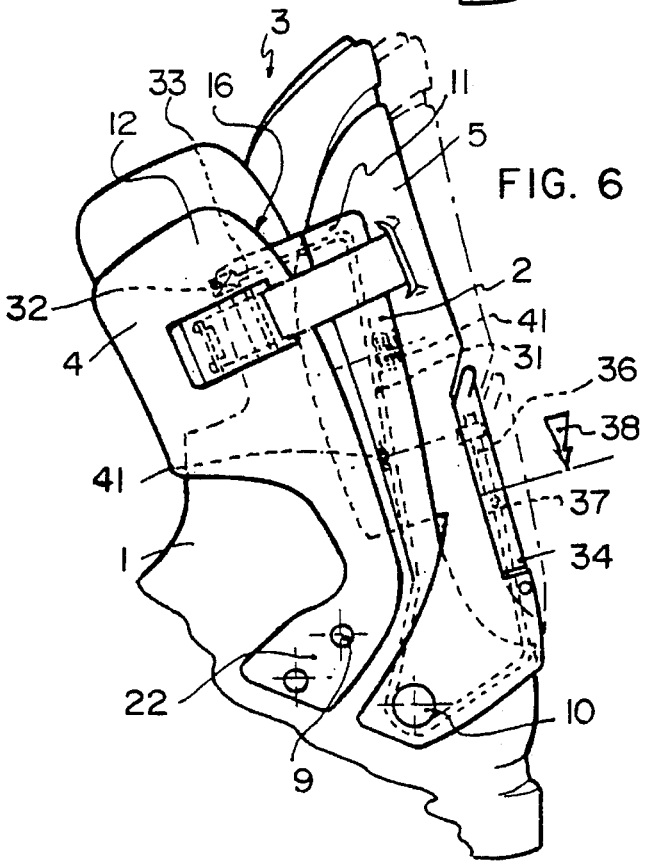

In such a case, FIG. 6, front cuff 4 pivots frontwardly about its linkage 9 while driving, by means of its wings 12, ends 32 of link 31 which, when pressured, blocks the movement of front cuff 4 thereby constituting the abutment means determining the so-called "stiffness" position.

In order to avoid an uncontrolled or random loosening of link 31 within the structure of the boot, especially when a relatively substantial portion of its length is released, an elastic tensioning system is provided to recuperate this released length and to maintain said link 31 in a state of tension.

In FIGS. 5, 5*a*, 5*b* and 6, the tensioning system is schematically shown by two springs 41 arranged inside hollow structure 40 of vertical extensions 2, opposite and offset with respect to the linkage. Thus, in release position of link 31, FIG. 5, the latter is transversely deviated substantially along an "S"-shape by following a longer path between its guides 33 and 10. Inversely, in maximum flexion position of front cuff 4, FIG. 6, the tension exerted on link 31 forces springs 41 to compress and therefore release the length of said link 31 which they had stored previously.

According to this embodiment example, the elastic tensioning system is positioned between adjustment tensioner 34 of the length of link 31 and hooking points or ends 32 of the latter on wings 12 of front cuff 4.

Another advantage resulting from the embodiment of an elastic tensioning system is the fact that wings 12 of front cuff 4 are automatically brought along 42 in support position against abutments 11 and vertical extensions 2 during the tensioning of link 31, because the fastening points of ends 32 of the latter are opposite guiding openings 33.

It is obvious that different tensioning systems can be adapted to the ski boot without departing from the scope of the invention and that in particular, these systems can be positioned towards the fastening points of the linkage or towards the adjustment tensioner.

Figure 7:
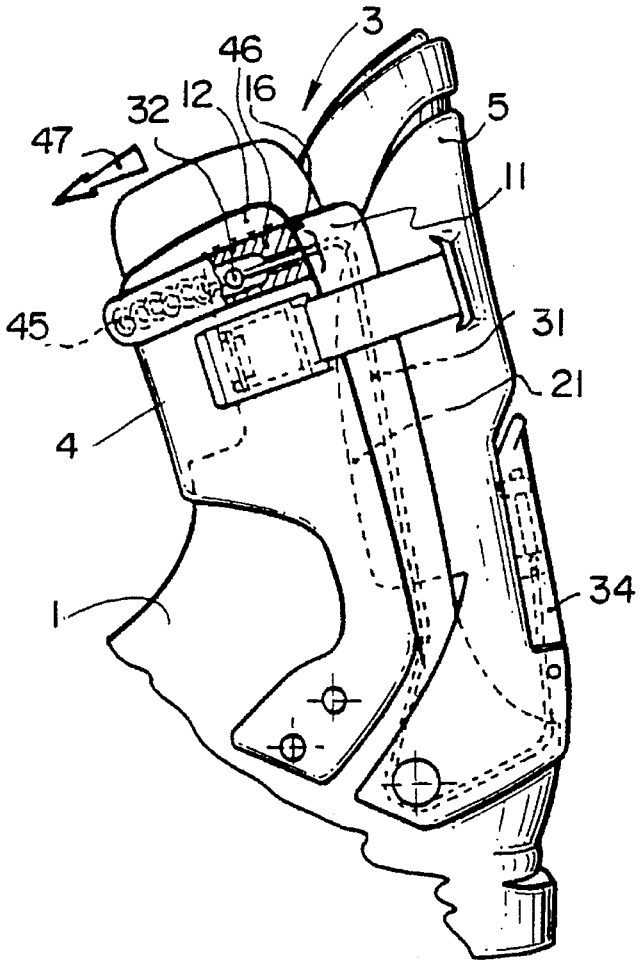
FIGS. 7 and 8 show an embodiment of an elastic tensioning system, cooperating with a single link of the clearance amplitude limitation device of the front cuff at the location of its fastening points on the wings of the latter.
Figure 8:
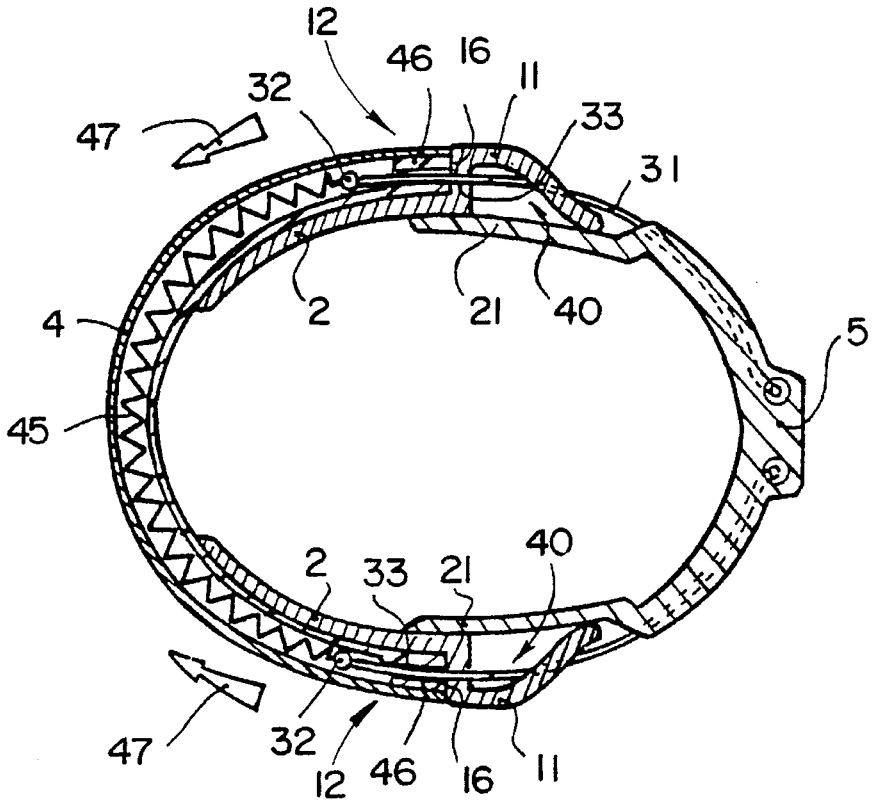

Thus, in FIGS. 7 and 8, the tensioning system is arranged to act in traction on fastening ends 32 of link 31. To this end, a traction spring 45 takes support on front cuff 4 and is hooked to ends 32 of link 31 which are only retained on wings 12 of the front cuff 4 by shoulders 46 located opposite abutments 11 and 16. When link 31 is relaxed, its released length is then recuperated by spring 45 which pulls on the two ends 32 thereof while distancing them from shoulders 46 as indicated by arrows 47.

In the examples described with reference to the preceding FIGS. 5–8, the clearance amplitude limitation device of front cuff 4 uses a single link 31 forming a half-buckle which is closed by the front cuff 4. It is readily understood that the limitation device can also comprise two independent inextensible flexible linkages 50, as represented schematically in FIGS. 9 and 9*a*. In such a construction, each linkage 50, arranged on a side of the boot, connects corresponding wing 12 of front cuff 4 to vertical extension 2 of shell base 1 located opposite therefrom, and comprises its own tensioner 51 and possibly, its elastic tensioning system 52. As an example, tensioner 51 illustrated in FIGS. 9 and 9*a* is of the "wheel" type, i.e., the adjustment carried out along the length of linkage 50 is obtained progressively by screwing or unscrewing of wheel 53; this wheel, translationally immobilized along vertical extensions 2, causes the translational displacement of end 54 of said linkage 50 constituted by a threaded connecting piece, whereas the other end 55 is mounted on wings 12 of front cuff 4 to hook and press onto shoulders 46 in case of front flexion.

In order to enable the recuperation of the length of linkage 50 intended to be released to provide a possible clearance of front cuff 4, fastening end 55 of the latter is provided to slide freely on the side of its connection with elastic tensioning system 52, as indicated by the arrow.

Figure 5A:
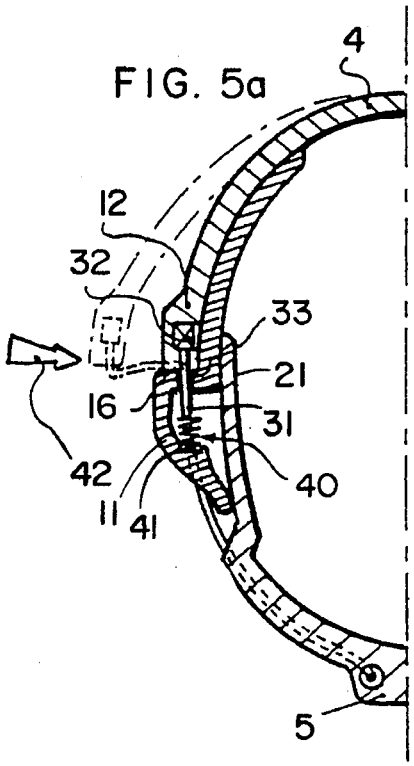
FIG. 5*a* shows a partial sectional view along B—B of FIG. 5, of a mounting detail of the connection of the link with respect to the abutments of the corresponding vertical extension of the shell base and of the front cuff.
Figure 5:
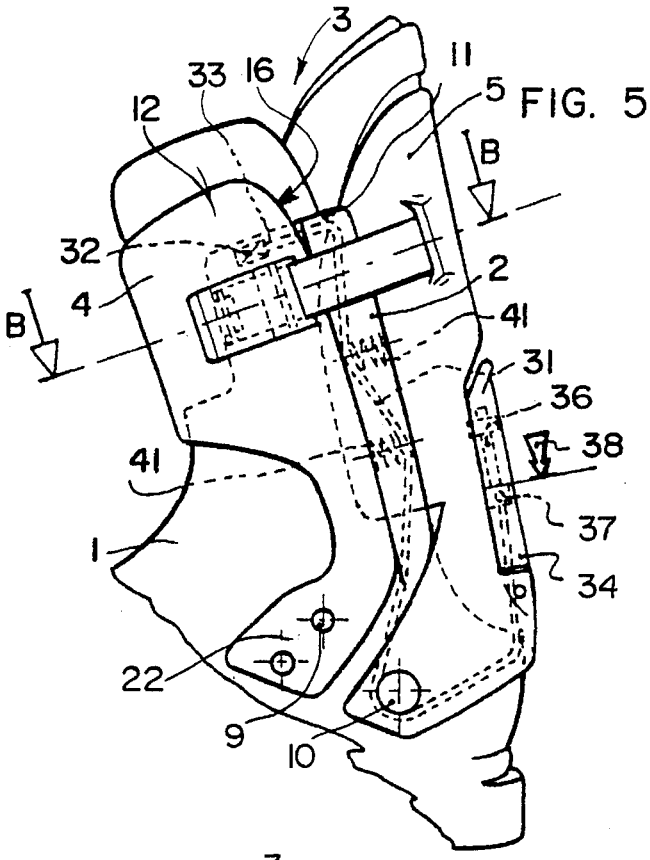
FIGS. 5 and 6 partially show the boot of FIGS. 1 and 2 provided with a device for limiting the frontward clearance amplitude with an elastic tensioning system inserted between the fastening points of the link on the front cuff and the tensioner.

In FIG. 10, the ski boot shown has an upper 3 whose structure is identical to that of FIGS. 1 and 2 and differs from that of FIGS. 5 and 6 in that the elastic tensioning system is incorporated with an adjustment tensioner 60. In this constructional example, tensioner 60, represented in detail in FIGS. 11, 12 and 13, is of the toggle joint type; it is journalled to rear spoiler 5 on an axis 61, and is maintained in abutment 62 in its housing 63 obtained in the rear portion of said rear spoiler 5, under the tension effect of link 31 and of an elastic element such as a spring 71 inserted between the latter and adjustment cursor 72. Due to this assembly, the modification of the position of cursor 72 on threaded axis 73 (visible in FIGS. 11 and 13) changes the length of releasable link without said link 31 changing position on tensioner 60; indeed, when cursor 72 is pushed back to the end (FIG. 11), or screwed with a value "X" (FIG. 13), support slide 74 of link 31 remains in high abutment position under the thrust effect of spring 71, and it is merely the possible clearance path "U" of slide 74 (FIG. 11) which changes from "X" to give "L" (FIG. 13). This clearance path of slide 74 corresponding to a certain length of link 31 releasable by compression of spring 71 results in front cuff 4 not being capable of bending frontwardly along 69 (FIG. 10) except in proportion thereof.

The invention described hereinabove with reference to FIGS. 1–13 is obviously not limited to ski boots whose shell base is of a predetermined type; thus, shell base 1 of the boot illustrated in FIGS. 1, 2 and 4, is closed in its upper portion corresponding with the top of the foot by means of a flexible cuff 19, that of the boot of FIG. 3 is closed by transverse flaps 23, and that of the boots of FIGS. 5, 6, 7, 9 and 10 is closed by a continuation of the sides along the top of the foot.

Figure 5B:
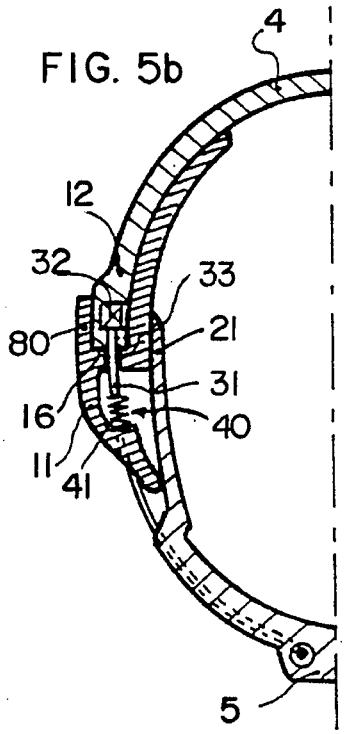
FIG. 5*b* shows another embodiment of the vertical extension of the shell base in the abutment zone.

Likewise, the characteristic portions of the invention can comprise accessory arrangements without departing from the scope of the latter; to this end for example, abutments 11 obtained on extensions 2 of shell base 1 can be provided with deflectors 80 as illustrated in FIG. 5*b*. Furthermore, abutments 11 can be attached to vertical extensions 2 and be adjustable in position on the latter, especially in the horizontal direction in order to enable modification of the advance angle of upper 3. Obviously, the abutments of front cuff 4, constituted by rear edges 16 of these wings 12, can also be replaced by attached and adjustable elements.

Finally, flexible link 31, 50 of the clearance amplitude limitation system of front cuff 4 can be arranged on the latter by forming a half-buckle and fastening to vertical extensions 2 where the elastic tensioning system 45, 52 is possibly arranged. It is obvious that a tensioner 34, 51 or 60 can also be provided on front cuff 4 when flexible link 31, 50 is arranged on the latter and is fastened onto vertical extensions 2.

The use of an inextensible flexible link 31, 50 is preferable, but does not exclude using an elastically extensible linkage in the boot according to the invention.

The instant application is based upon French patent application 93.12454 of Oct. 15, 1993, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed:

1. A ski boot comprising:

a shell base;

an upper mounted upon said shell base, said upper comprising a rear spoiler and a front cuff, said front cuff having a channel-shaped upper portion corresponding to a front portion of a skier's lower leg and a pair of lower portions extending downwardly along respective lateral portions of said shell base, said lower portions being fastened and journalled to said shell base, said rear spoiler being journalled to said shell base;

said lower portions of said front cuff further comprising respective elastic elements for ensuring control of flexion of said upper in a rear-to-front direction;

said upper portion of said front cuff includes an opening, whereby said front cuff does not cover said shell base in an area corresponding to above the instep;

said front cuff further comprising rearwardly facing abutment portions;

extensions vertically extending from said lateral portions of said shell base to areas corresponding with sides of the skier's ankle and lower leg, said extensions comprising abutments for limiting movement of said front cuff, said abutments being located in upper areas of said extensions opposite said abutment portions of said front cuff for engagement with respective ones of said abutment portions of said front cuff;

a tightening and closure device for mutually connecting said front cuff and said rear spoiler on said extensions of said shell base; and said elastic elements of said front cuff being affixed in a pre-stressed condition tending to force said front cuff in a front-to-rear direction to maintain mutual engagement between said abutments of said extensions and said abutment portions of said front cuff, thereby consequently maintaining said front cuff in a blocking position in the front-to-rear direction and in a controlled flexion position in a rear-to-front position.

2. A ski boot according to claim 1, wherein:

said rearwardly facing abutment portions are constituted by rear-edges of said front cuff.

3. A ski boot according to claim 1, wherein:

at least one of said abutments of said extensions and of said abutment portions of said front cuff are adjustable in position on said extensions or said front cuff, respectively.

4. A ski boot according to claim 1, wherein:

said extensions of said shell base form a transversely extending U-shape, said U-shape being closed frontwardly by said front cuff, said front cuff having lateral wings partially covering said extensions, said U-shape being closed rearwardly by said rear spoiler, said rear spoiler having lateral wings extending within said extensions of said shell base.

5. A ski boot according to claim 1, wherein:

said elastic flexion control elements are constituted by portions of said lower portions of said front cuff extending below respective journal axles at said shell base, said elastic flexion control elements being affixed and immobilized on said shell base.

6. A ski boot according to claim 1, wherein:

said elastic flexion control elements are constituted by a flexion bar attached to respective ones of said lower portions of said front cuff.

7. A ski boot according to claim 1, further comprising:

a device for limiting an amplitude of movement of said front cuff in the rear-to-front direction, said device being positioned in an upper area of said extensions, substantially opposite said upper portion of said front cuff, said device comprising:

at least one flexible linkage connected to said front cuff and to at least one of said extensions of said shell base in an area of said abutments; and at least one tensioner for adjusting an active length of said flexible linkage for releasing said flexible linkage between fastening points for providing a predetermined range of movement of said front cuff with respect to said extensions.

8. A ski boot according to claim 7, wherein:

said amplitude limiting device comprises a single flexible linkage extending from a connection with said front cuff, downwardly along said extensions of said shell base, around the journal of said rear spoiler, upwardly along said rear spoiler, to a connection at said tensioner, said tensioner having means for adjusting a position of said connection on said tensioner.

9. A ski boot according to claim 7, wherein:

said amplitude limiting device comprises two separate links respectively connected to said tensioner for adjusting active lengths of said links, said tensioner being located on either the front cuff or either of said extensions.

10. A ski boot according to claim 7, further comprising:

an elastic tensioning system for maintaining said flexible linkage of said amplitude limiting device in a state of tension, regardless of an adjustment position of said tensioner.

11. A ski boot according to claim 7, further comprising:

a spring associated with said tensioner for adjusting an active length of said flexible linkage and for cooperating with said flexible linkage for maintaining said flexible linkage in a state of tension by a compression force of said spring being applied to a support slide of said tensioner to which said flexible linkage is effectively connected for withdrawing a length of said flexible linkage adapted to be released by a force opposing said force of said spring.

12. A ski boot according to claim 7, wherein:

said abutments of said vertical extensions of said shell base are constituted by projections extending along said extensions, said projections having, opposite said abutment portions of said front cuff, a support surface facing said abutment portions;

said flexible linkage connected to said front cuff is applied on rear edges of said front cuff and then passes through a guide opening provided in said support surface of said abutments and is fastened onto said tensioner for adjusting an active length of said flexible linkage.

13. A ski boot according to claim 10, wherein:

said elastic tensioning system is arranged between said tensioner, for adjusting the active length of said flexible linkage, and a connection of said flexible linkage at said front cuff; and said elastic tension system comprises means for modifying a path of said flexible linkage while a release length of said flexible linkage is recovered by said elastic tensioning system.

14. A ski boot according to claim 10, wherein:

said elastic tensioning system is arranged at a connection end of said flexible linkage opposite that connected to said tensioner for adjusting an active length of said flexible linkage.

15. A ski boot according to claim 10, wherein:

said elastic tensioning system is integrated with said tensioner for adjusting an active length of said flexible linkage.

* * * * *